United States Patent [19]

Tragesser

[11] Patent Number: 4,475,019

[45] Date of Patent: Oct. 2, 1984

[54] PUFFER-TYPE COMPRESSED GAS CIRCUIT INTERRUPTER

[75] Inventor: Charles W. Tragesser, Murrysville, Pa.

[73] Assignee: Westinghouse Electric Corp., Pittsburgh, Pa.

[21] Appl. No.: 476,745

[22] Filed: Mar. 18, 1983

[51] Int. Cl.[3] ..... H01H 33/88

[52] U.S. Cl. ..... 200/148 A; 200/148 R

[58] Field of Search ..... 200/148 A, 148 R

[56] References Cited

U.S. PATENT DOCUMENTS

| | | | |
|---|---|---|---|
| 4,105,880 | 8/1978 | Rapp et al. | 200/148 A |
| 4,149,051 | 4/1979 | Milianowicz et al. | 200/148 A |
| 4,276,456 | 6/1981 | Cromer et al. | 200/148 A |
| 4,434,334 | 2/1984 | Tragesser | 200/148 A |

*Primary Examiner*—Robert S. Macon

*Attorney, Agent, or Firm*—M. S. Yatsko

[57] ABSTRACT

According to this invention, therein is provided a puffe-type compressed gas circuit interrupter comprising stationary and movable contacts and a stationary cylinder, a movable piston, connected to the movable contacts and which slides in the stationary cylinder to compress the sulfur hexafluoride insulating gas therebetween to provide a puffing action to extinguish the arc drawn between the separating stationary and movable contacts. The puffer apparatus is disposed within an insulating tube which has a plurality of openings therein disposed about the stationary contact. The tube, with the puffer apparatus disposed therein, is disposed within an outer metallic housing in which an insulating barrier is further disposed between the insulating tube and the housing. The insulating barrier, which lines the inside of the outer housing, is disposed adjacent to the apertures in the insulating tube so as to prevent a dynamic insulation breakdown to ground.

9 Claims, 13 Drawing Figures

PUFFER-TYPE COMPRESSED GAS CIRCUIT INTERRUPTER

CROSS-REFERENCE TO RELATED APPLICATION

Cross-reference is made to the copending application Ser. No. 193,067, filed Oct. 2, 1980, entitled "Circuit Interrupter", which copending application is assigned to the same assignee as the present application.

BACKGROUND OF THE INVENTION

1. Field of the Invention

This invention relates generally to puffer-type compressed gas circuit interrupters, and more particularly to subtransmission type circuit interrupters.

2. Description of the Prior Art

Application of circuit interrupters in the subtransmission voltage classifications has been dominated by the low cost oil circuit breaker. Even with the flammable properties of oil and the high degree of maintenance associated with the oil circuit breaker, the high cost of $SF_6$ puffer-type breakers have not allowed power engineers to benefit from the advantages of $SF_6$ technology. An $SF_6$ puffer-type circuit interrupter has been needed in the subtransmission voltage classifications that allows power engineers the opportunity to take advantage of the new $SF_6$ technology at a cost competitive with oil circuit breakers.

SUMMARY OF THE INVENTION

According to this invention, therein is provided a puffer-type compressed gas circuit interrupter comprising stationary and movable contacts and a stationary cylinder, a movable piston, connected to the movable contacts and which slides in the stationary piston to compress the sulfur hexafluoride insulating gas therebetween to provide a puffing action to extinguish the arc drawn between the separating stationary and movable contacts. The puffer apparatus is disposed within an insulating tube which has a plurality of openings therein disposed about the stationary contact. The tube, with the puffer apparatus disposed therein, is disposed within an outer metallic housing in which an insulating barrier is further disposed between the insulating tube and the housing. The insulating barrier, which lines the inside of the outer housing, is disposed adjacent to the apertures in the insulating tube so as to prevent a dynamic insulation breakdown to ground.

BRIEF DESCRIPTION OF THE DRAWINGS

Reference is now made to the description of the preferred embodiments, illustrated in the accompanying drawings, in which.

DESCRIPTION OF THE PREFERRED EMBODIMENTS

Figure 2:
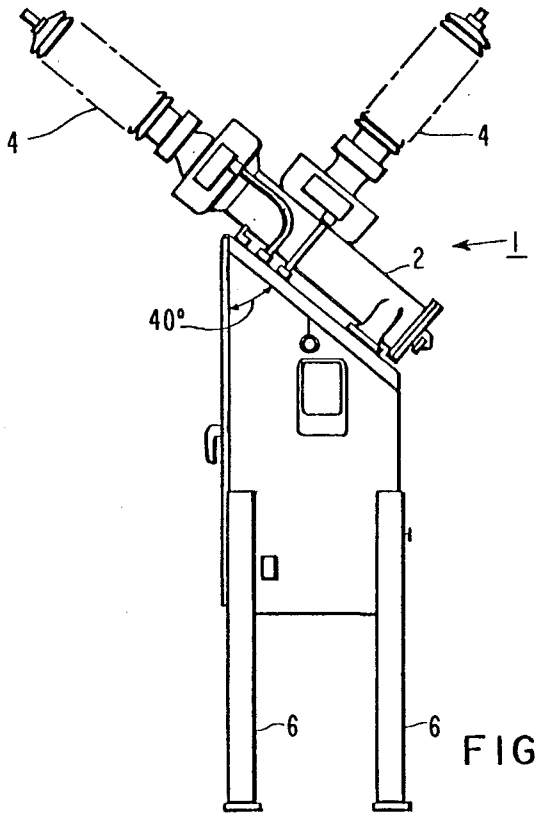
FIG. 2 is an end view of the circuit interrupter shown in FIG. 1.
Figure 1:
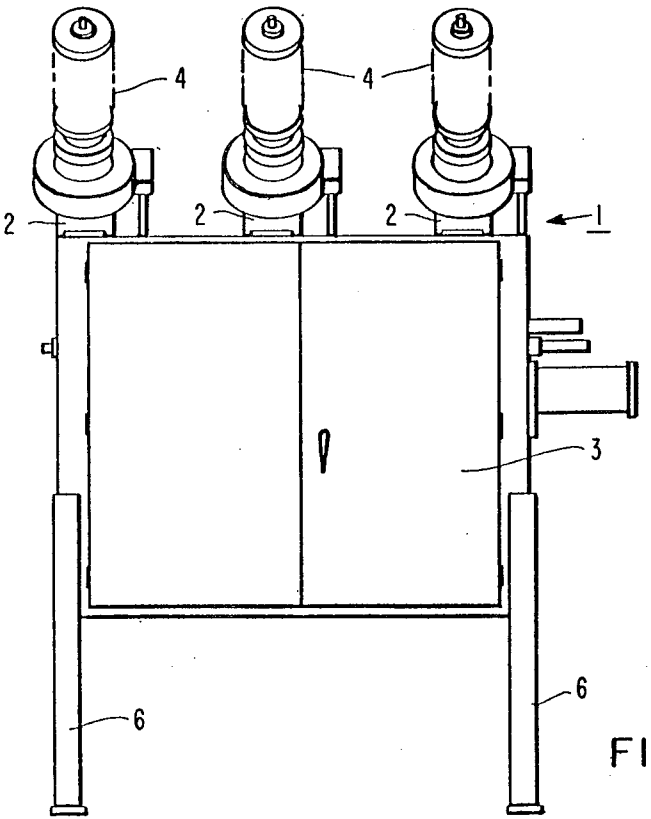
FIG. 1 is a front view of the circuit interrupter incorporating the principles of this invention.
Figure 4:
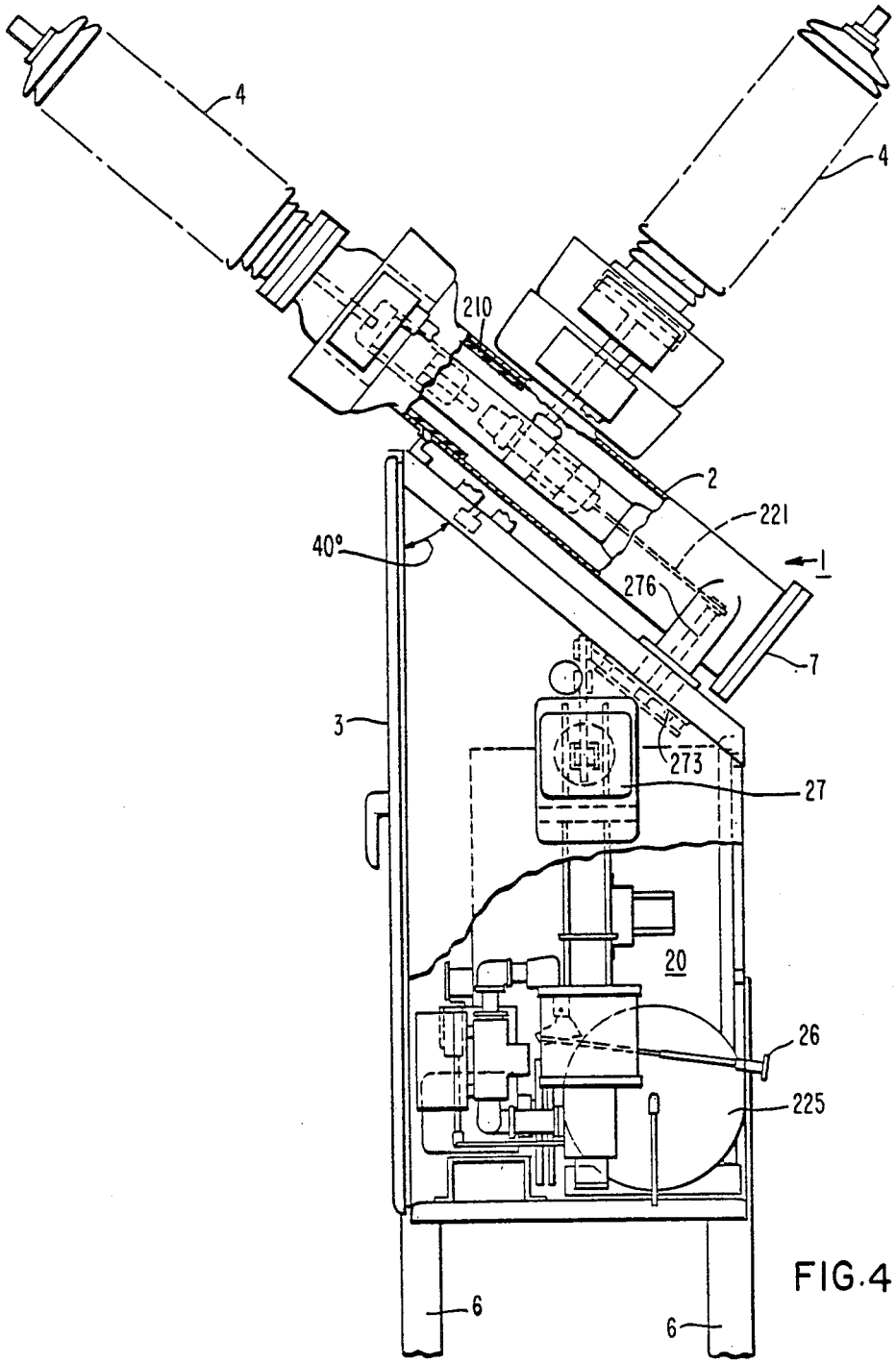
FIG. 4 is a view similar to FIG. 2 but with parts broken away.

There is shown in FIGS. 1, 2 and 4 a circuit interrupter 1 generally comprised of a control housing 3, an interrupter assembly 2, and a drive mechanism 20. The control housing 3 is supported on four legs 6. These legs are removable for shipping and easily support the 3000 lb. weight of the circuit interrupter 1 when bolted down. The roof of the control housing 3 is sloped at an angle of 40 degrees. Mounted upon the control housing roof are three interrupter assemblies 2 for each phase of a three phase system. Connected to the assemblies 2 are terminal bushings 4 for terminating the incoming power lines. The 40 degree slope in the control housing roof is designed to allow the arc products and particles to migrate due to gravity to the ground end of the interrupter assembly 2 away from the high voltage field. An inspection plate 7 allows the assembly to be easily cleared and maintained.

Figure 5:
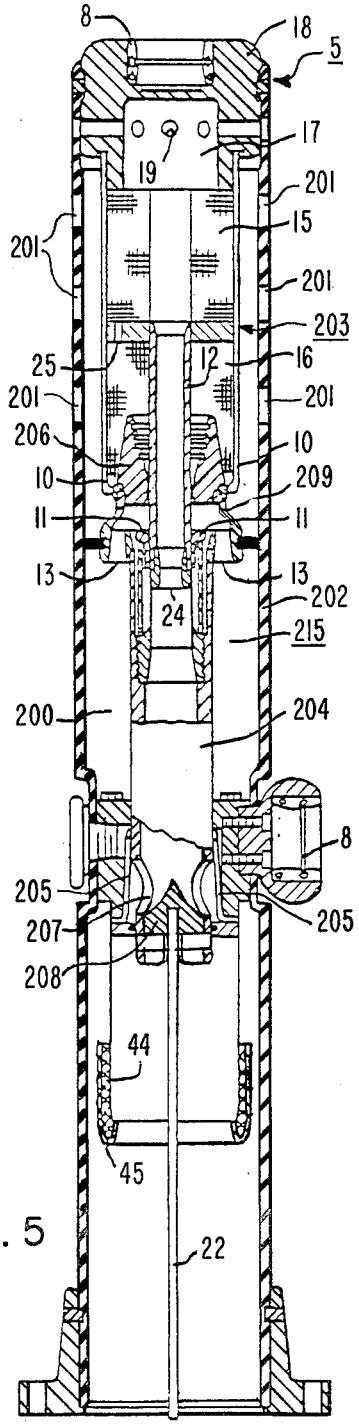
FIG. 5 is an elevational sectional view of the interrupter assembly with the contacts in the closed circuit position.
Figure 6:
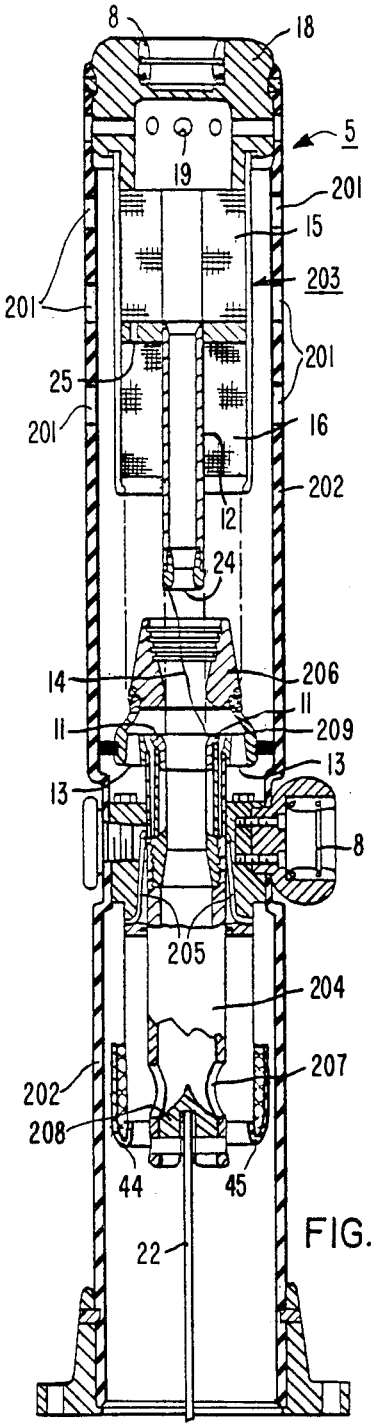
FIG. 6 is a view similar to FIG. 5 but with the contacts in the open circuit position.

The interrputer assembly 2 is shown in greater detail in FIGS. 5 and 6. It will be observed that there is provided a puffer-type compressed gas circuit interrupter 5 having an insulating housing 202, with a relatively stationary contact assembly 203 and a relatively movable contact assembly 204 contained within the housing 202. The housing 202 is generally comprised of a filament wound glass epoxy material and has a plurality of apertures 201 therein in the vicinity of the stationary contact assembly 203. Two sets of transfer contacts 8 are provided to make a plug-in connection with the bushing conductors for the incoming and out-going power lines. This plug-in connection allows any movement between the interrupter and the bushings due to thermal expansion or operations to be compensated for in the transfer contacts 8 instead of imposing additional stress on the bushing assembly or the interrupter assembly. In the closed position current is transferred from the bushing conductor entering on one side of the housing 202 through transfer contacts 8 to a pair of finger contacts 205 that make a connection with the movable contact assembly 204 from the movable contact assembly 204 to the stationary contact assembly 203, and exits the interrupter assembly through a second set of transfer contacts 8 at the top of the housing 202.

Figure 7:
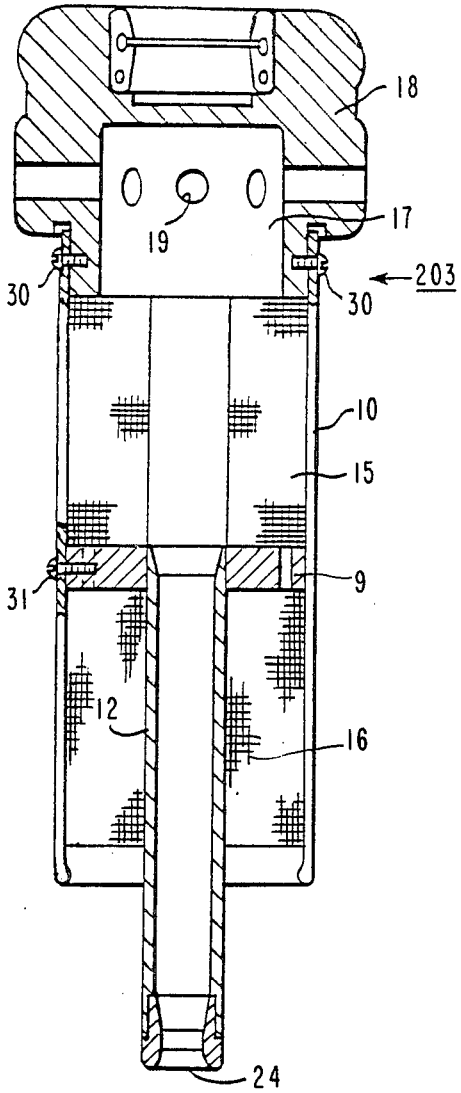
FIG. 7 is a sectional view of the stationary contact structure.
Figure 8:
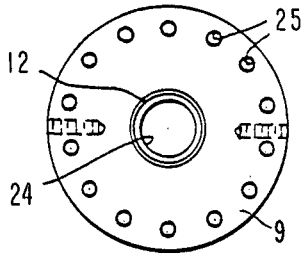
FIG. 8 is a sectional view taken generally along the lines VIII—VIII of FIG. 9.
Figure 9:
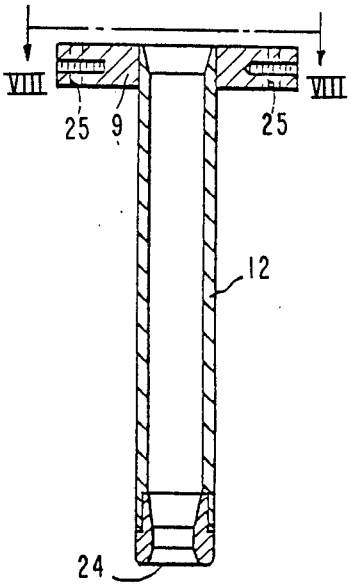
FIG. 9 is a sectional view of the stationary arcing contact structure.

Referring now to FIGS. 7, 8 and 9 the stationary contact assembly 203 is generally comprised of a stationary contact base 18 with fourteen equally spaced stationary contact fingers 10 mounted to the base by means of screws 30. A pair of copper venting screens 15, 16 are placed within the stationary contact fingers 10 between the base 18 and a stationary arcing contact 12 and between the fingers 10 and the arcing contact 12 near the ends of the fingers 10, respectively. The arcing contact 12 is mounted to the stationary contact fingers 10 by means of mounting screws 31 with the screen 16 being mounted to the base 9 of the stationary arcing contact 12. The arcing contact 12 has a center opening 24 and (14) vent openings 25 in its base 9. During interruption, hot gasses are exhausted upstream through the center opening 24 and venting openings 25 to the copper venting screen 15. Furthermore, hot gasses are also exhausted through the copper venting screen 15 and out through the gap (not shown) between the adjacent contact fingers 10. The gas which is exhausted through the copper venting screen 15, together with the vent openings 24 and 25, cooperate with the vent openings 17 and 19 in the stationary contact base 19 for upstream exhaust. As these hot gasses exit from the stationary contact assembly 203, they exit through the insulating housing 202 through the openings 201 spaced therein so as to be removed from the interruption area.

Figure 10:
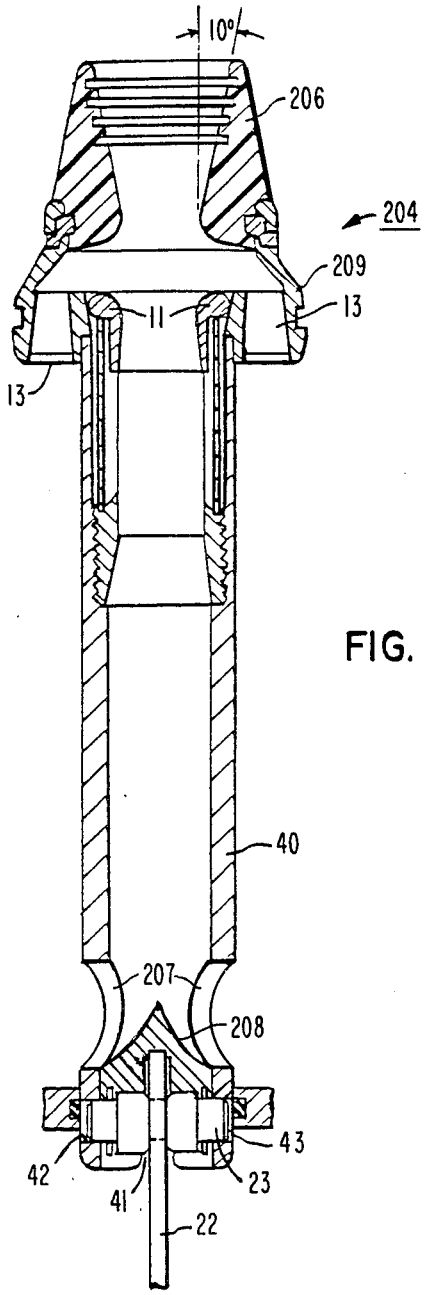
FIG. 10 is a sectional view of the movable contact structure.

FIG. 10 illustrates the movable contact assembly 204. The movable contact assembly 204 is generally comprised of a movable hollow tube structure 40 upon which is connected a piston structure 209. The piston structure 209 includes arcing contacts 11 that make contact with the stationary arcing contacts 12 and arc blast openings 13 that are blocked closed when the two arcing contacts 11 and 12 are making contact and open when these arcing contacts part during interruptions. Mounted upon the piston structure 209 is a Teflon orifice 206 having a diverging angle between 8°–12° that directs the arc blasts from openings 13 into the arc 14 (see FIG. 6) established between the arcing contacts 1 and 13 during the opening operations. It has been discovered by experimentation that a diverging angle of 10° provides optimum performance under high current conditions. The lower portion of the movable contact assembly 204 includes vent openings 207 in the hollow tube structure 40 and openings 41, 42, and 43 for connecting an operating rod 22 by means of a pin 23. A flow shaper 208 is disposed adjacent to the vent openings 207 and directs the flow of insulating gas exhausting down through the interior of the hollow tube structure 40 out through the vent openings 207.

During the opening operation the operating rod 22 is operable to move the movable contact assembly 204 in a downward direction. On opening, the piston structure 209 separates from the stationary contact fingers 10 and compresses the gas 200 within the region 215. Initially thereafter contact is only maintained between the stationary arcing contact 12 and the movable arcing contact 11. Downward continuing motion of the operating rod 22 continues to force the piston structure 209 downwardly within the housing 202 compressing gas 200 in the region 215. Upon separation of the arcing contacts 11 and 12 arc blast openings 13 are unblocked and the gas 206 is forced through the arc blast openings 13 upwardly through the orifice 206 into the arc 14 established between the arcing contacts 11 and 12 as illustrated in FIG. 6. Hot gasses and arcing products are swept upstream away from the interrupting region through the center opening 24 and the vent openings 25 of the stationary arcing contact 12 and are cooled by the screens 15, 16. This upstream exhaust is important to establish long arc time and maximum current interrupting conditions where the maximum gas flow is required to reduce the plasma temperature for efficient interruption. On opening, hot gasses are also vented downstream through the center of the movable hollow tube structure 40 and are directed out the vent openings 7 by the flow director 208. These gasses are cooled by means of a copper venting screen 44 contained within a copper shielding 45. Thus, this double-flow exhaust greatly improves the interrupting capability of the puffer-type interrupter described herein by maintaining a high dielectric strength in the interrupting region after opening. To prevent a dynamic insulation breakdown to ground from occurring as the hot gas exhausts out of the housing 202 through the openings 201, an insulating barrier 210 (see FIG. 4) is disposed within the outer metallic housing 2, and lines the interior side of the housing 2. As the hot gasses exhaust through the openings 201 of the insulating tube 202, impinge upon the insulating barrier 210, and thus a dielectric breakdown is prevented.

The insulating barrier 210 is comprised of many layers of a continuous dielectric material which are rolled into the tubular structure. By being so constructed, the multi-layered insulation barrier has a greater dielectric capability than a solid barrier of the same thickness. Furthermore, by being constructed by being rolled, the insertion of the barrier 210 within the housing 202 is simplified, for the insertion can take place through a smaller opening than the final required diameter of the insulating barrier 210. This occurs because the layers of the insulating barrier 210, and its diameter expand once it has been inserted within the housing 2, much like a rolled sheet of paper will expand in diameter when a restraining force thereon is removed.

Figure 3:
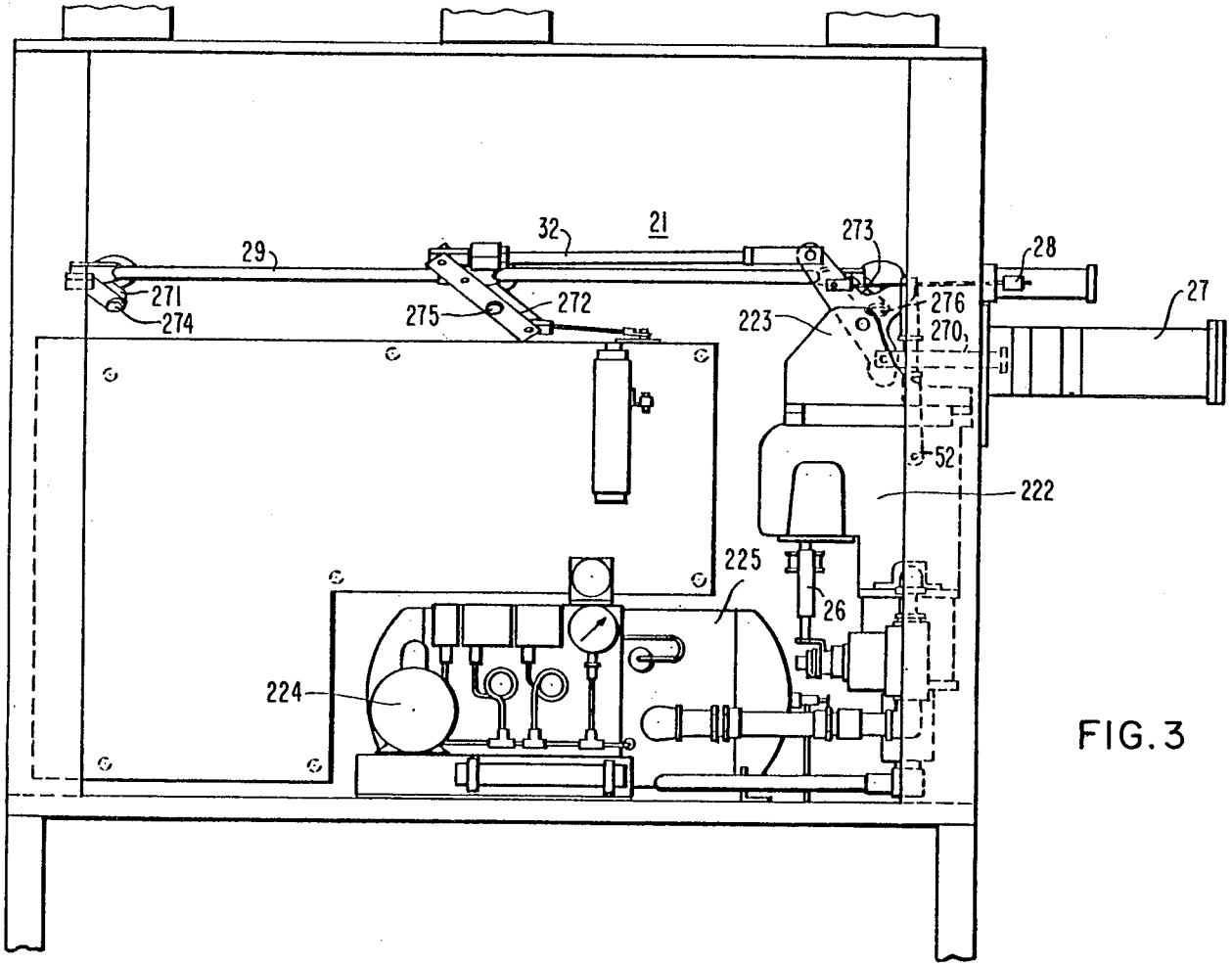
FIG. 3 is similar to FIG. 1 but illustrates some of the details internal to the housing.

There is shown in FIGS. 3 and 4 a drive mechanism for operating the circuit interrupters 2 mounted on the sloped roof of the mechanism housing. The drive mechanism 20 is comprised generally of a linkage 21, a trip mechanism 222, a bell crank 223, compressor and motor 224, storage reservoir 225, and a hand trip lever 26. Also included in the control cabinet are the necessary auxiliary switches, cut-off switches, alarm switches, control relays, and operational counter and other normal equipment, not shown but well known in the art. The trip mechanism 222 is of the type disclosed in U.S. Pat. No. 3,450,955, issued June 17, 1969, to F. D. Johnson. Energy for opening the circuit interrupter is stored in the tail spring 27 located on the control housing 3, permitting the breaker to be tripped with a low energy signal. When tripped, the spring 27 transmits its energy to linkage 21, which transfers the motion to the operating rod 221 and the movable contacts 204. To close the breaker a low energy signal actuates an air valve, not shown, on the trip mechanism 222. High pressure air stored in the reservoir 225 operates against a piston in the trip mechanism 222. The closing force is transmitted through the linkage assembly 21 to the tail spring 27 and the movable contacts 204.

Figure 13:
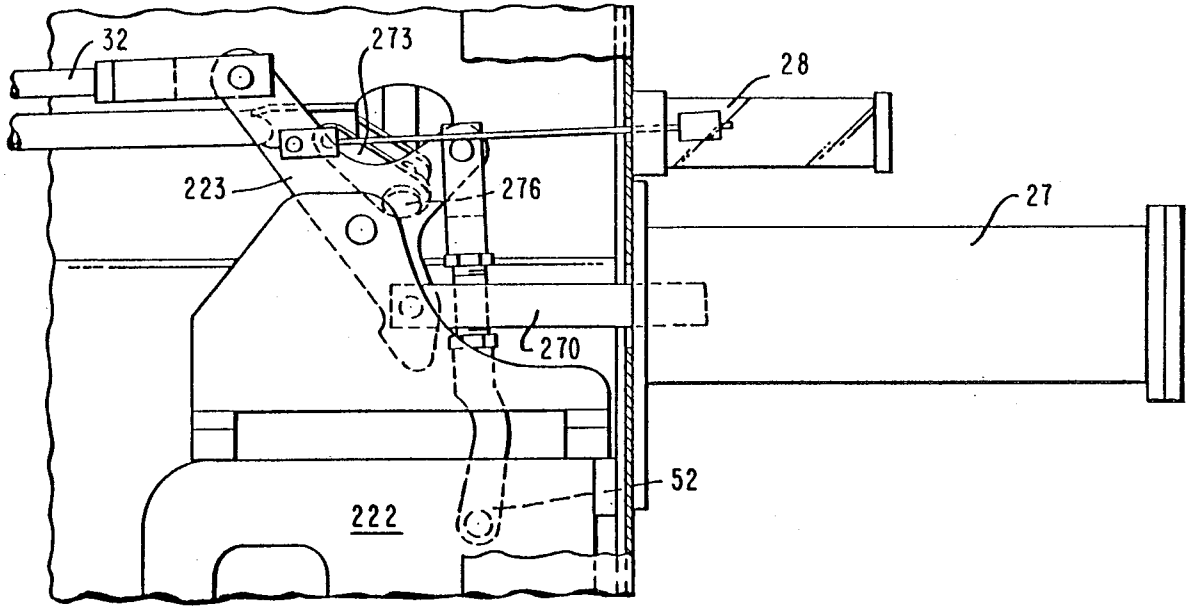
FIG. 13 is a partial exploded view of the bell crank and pull rod assembly illustrated in FIG. 3.

The bell crank 223 is connected to the pull rod 52 of the trip mechanism 222. When this connection is made, initial adjustments are also made to align the bell crank 223 with the tripped and untripped positions of the trip mechanism 222 to ensure that the linkage 21 moves in correspondence with the respective open and closed positions of the circuit interrupters. The accelerating spring 27 is also connected to the bell crank 223 by means of a rod 270 (see FIG. 13). A position indicator 28 is connected to the bell crank 223 to indicate the operating positions of the system. A rigid, solid tie rod 29 connects all three phases together at the levers 271, 272, and 273 for each of the respective phases. These levers operate rotatable rods 274, 275, and 276 that extend through the housing into the respective circuit interrupters. The levers 271, 272, and 273 are disposed to transform horizontal displacement into rotational displacement by means of the rotating rods 274, 275 and 276. As seen in FIG. 4, the rotatable rods extend into the circuit interrupter housing and connect to the operating rods 221 to transform the rotating motion into the linear motion necessary to cause the opening and closing of the contacts 204, 203. The operating motion is directly caused by an adjustable operating arm 32 that connects bell crank 223 to the operating lever 272 of the middle phase. Because all of the phases are tied together by the tie rod 29, the operating arm 32 is able to operate all three phases in unison. The operating rod 32 is adjustable to further coordinate the motion of the bell crank 223 with the open and closed positions of the breakers. The operating rod 32 is comprised of self-aligning bearings or spherical bearings at each end to relieve any tension between the bell crank 223 and the lever 272 which is in a position parallel to the sloped housing. It will be noted that there are no adjustments between the three individual phases. These phases are rigidly and solidly connected to operate in unison. The only adjustments necessary are in the operating rod 32 and the bell crank 223 position to match the tripped and untripped positions of the tripping mechanism with the open and closed positions of the breaker.

Figure 11:
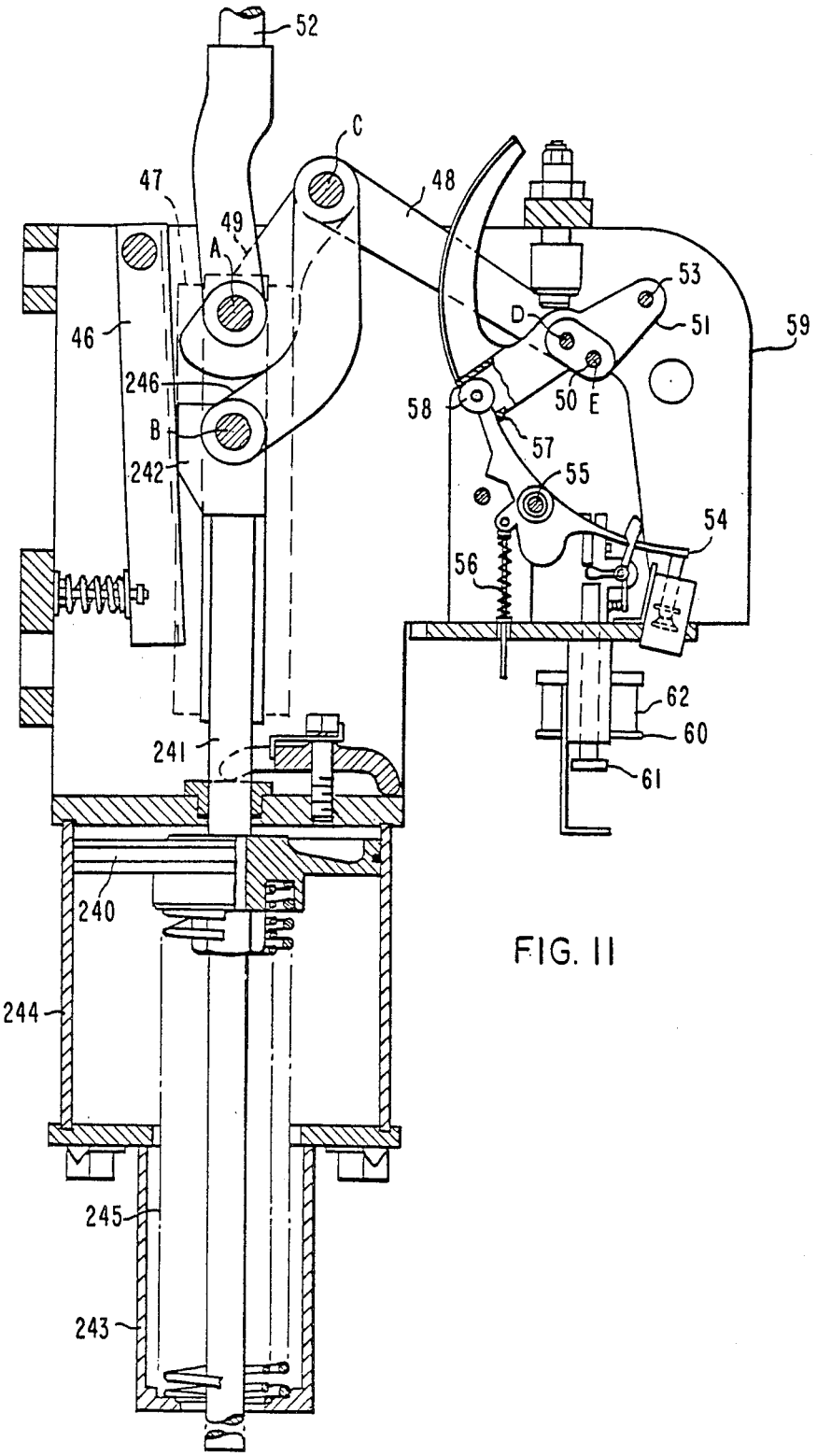
FIG. 11 illustrates the trip mechanism in the open position.
Figure 12:
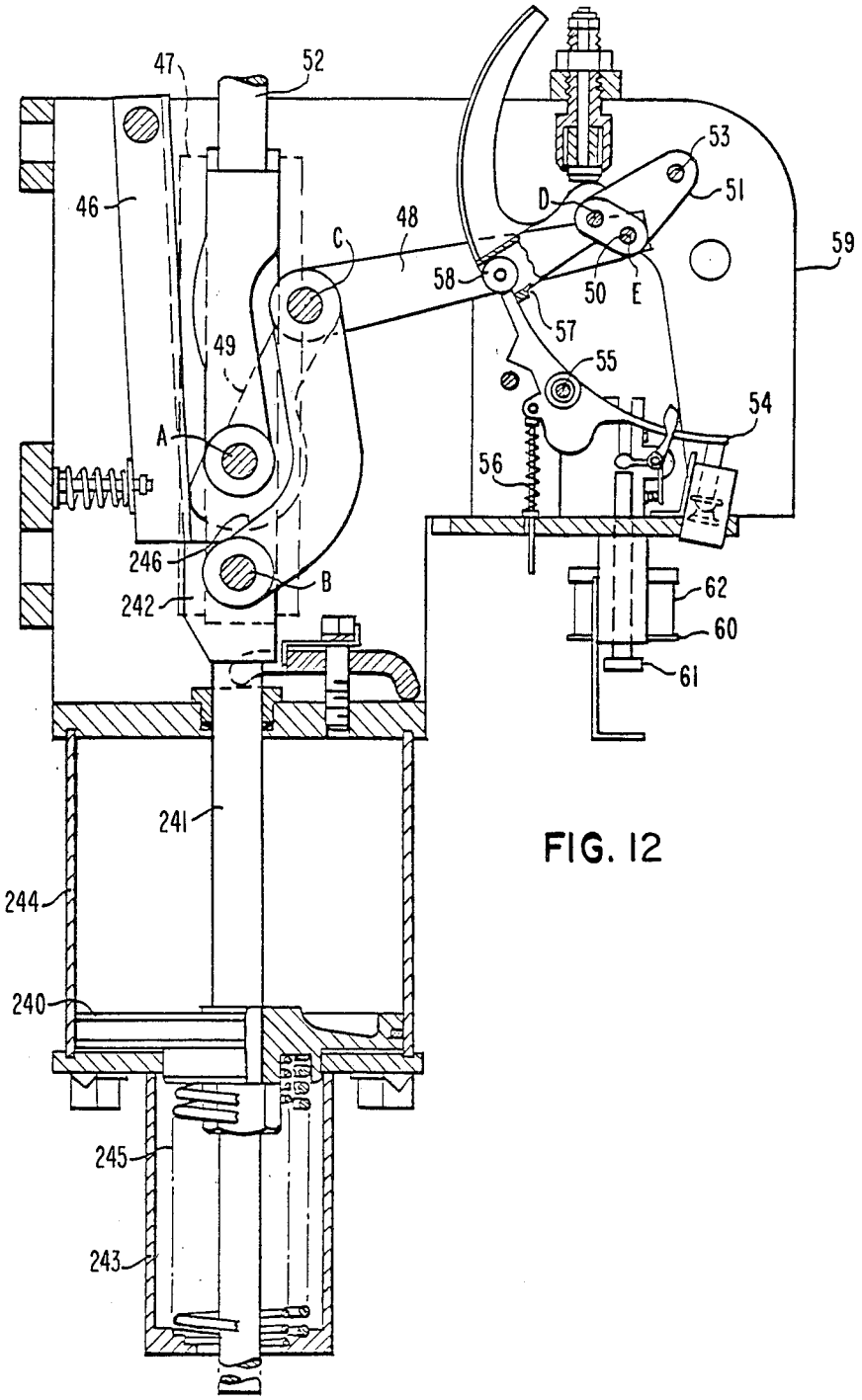
FIG. 12 illustrates the trip mechanism in the closed circuit position.

The trip mechanism 222 is shown in more detail in FIGS. 11 and 12. The main closing piston 240 is fastened to and approximately at the center of the piston rod 241. The upper end of the piston rod 241 carries the crosshead 242 which serves as a means attaching the mechanism's system of linkages and also provides an engagement surface for the main holding latch 46 to maintain the mechanism in the closed position. The spring housing 243 is part of the bottom plate of the cylinder 244 and supports the retrieving springs 245. The retrieving springs 245, which are compressed during the closing stroke, supply the force required to move the piston 240 back to the open or starting position following a trip-free operation, and reset the system of linkages to the open position in FIG. 11.

The closing links 246 are attached to the cross-head 242 by pin B. Rollers on either end of pin B run between the guide rails 47 and serve the dual purpose of guiding the upper end of the piston rod 241 and reducing the friction resulting from the side thrust of the closing links 246. Pin C joins the upper end of the closing links 246 to one end each of the intermediate link 48 and the cam lever 49. Pin A contacts the other end of the cam lever 49 to the breaker pull rod 52. Rollers at either end of this pin run between the guide rails 47 to constrain pin A to move in a vertical plane.

In order to transmit the motion of the closing piston 240 to the breaker pull rod 52, points A, B and C must be maintained in approximately the same relative position as shown in FIG. 11 or 12. This is accomplished by the following arrangement. The intermediate link 48 is connected to one end by pin C to the cam lever 49 and closing links 246, and at the other end by the thrust pin 50 to the trip-free lever 51 through either holes D or E, depending on the breaker load to which the mechanism is applied. To simplify the description, it is assumed that the pin is located in hole E as shown. As long as point E remains a fixed point, the intermediate link 48 will maintain points A, B and C in approxiamtely the same relative position of FIG. 11, and the closing piston 240 and pull rod 52 are effectively coupled and move in unison. By regulating point E so that it can be either maintained as a fixed center or release at will, the means are at hand to make the mechanism mechanically trip free. The releasable function of point E is accomplished by locating the thrust pin 50 between the fulcrum point of the trip-free lever 51 and the free or roller end. It will be noted from FIGS. 11 and 12 that the line through C–E is always below the trip-free lever fulcrum pin 53. Thus, the component of the breaker load which appears as a thrust on the intermediate link 48 will tend to rotate the trip-free lever 51 in a counterclockwise direction about the trip-free lever fulcrum pin 53. In order to keep the same force on the thrust pin with lightly loaded breakers and heavy loaded breakers, the thrust pin 50 is assembled in hole D for larger breaker applications and in hole E for the smaller breakers. A trigger 54, free to rotate on needle bearings about a fulcrum pin 55 and positioned approximately tangential to the direction of motion of the free end of the trip-free lever 51, provides the final releasable means of regulating the fixation of point D. The end of the trigger in engagement with the roller on the trip-free lever 51 is shaped in such a manner that there is a slight tendency for the trigger to rotate clockwise whenever there is a load on the breaker pull rod 52. This moment, in addition to the moment provided by the trip-free tripper spring 56, keeps the trigger against the trip-free trigger stop 57 on the trip-free lever 51, ensuring a definite engagement of the trigger and the roller 58. The long horn on the trip-free lever 51 serves to maintain the trip-free trigger 54 in the trip position whenever the mechanism is in any intermediate position between the fully closed or fully retrieved positions.

The trip magnet assembly is located on the underside of the frame 59 directly under the trip-free tripper 54. The trip rod 61 is screwed into and locked to the trip armature 60. The upper end of the rod 61 passes up to engage the tripper 54. When a signal energizes the trip coil 62, the trip rod 61 disengages the trip-free trigger 54.

When the trip mechanism 222 is tripped to open the breakers, it can readily be seen that motion is transferred to the pull rod 52 which disengages the accelerating spring 27 and causes fast, reliable motion through the linkage system 21 to the breakers mounted on the control housing.

I claim:

1. A circuit interrupter comprising:

a cylindrical, metallic outer housing having disposed therein an insulating gas;

an insulating barrier disposed within and contacting said outer housing;

an elongated insulating tube disposed within said outer housing and spaced apart from said insulating barrier, said barrier being disposed intermediate said outer housing and said tube;

a stationary contact disposed within said tube;

a movable contact longitudinally movable within said tube and cooperable with said stationary contact to open and close an electrical circuit;

means for blasting a flow of insulating gas into the arc established between said stationary and movable contacts during an opening operation; and means for moving said movable contact;

said tube having a plurality of radially directed openings therein in the vicinity of said stationary contact, and said barrier being disposed at least opposite said tube openings.

2. The circuit interrupter according to claim 1 wherein said stationary contact comprises a plurality of outer-disposed main stationary contact fingers and a hollow stationary arcing contact, and including a venting screen disposed intermediate said stationary arcing contact and said stationary contact fingers and extending to the vicinity of the end of said stationary contact fingers closest to said movable contact.

3. The circuit interrupter according to claim 2 wherein gas exiting from within said tube through said tube openings must pass through and be cooled by said venting screen.

4. The circuit interrupter according to claim 1 wherein said movable contact comprises an outer-disposed main movable contact and a hollow movable arcing contact disposed therewithin, said movable main and arcing contacts being secured and movable together, said movable arcing contact having a plurality of openings therein distal from said stationary contact, and including a flow director disposed within said movable arcing contact adjacent said movable arcing contact openings, said flow director directing the flow of insulating gas within said movable arcing contact out said movable arcing contact openings.

5. The circuit interrupter according to claim 4 including a cooling screen disposed across said movable arcing contact openings.

6. The circuit interrupter according to claim 1 wherein said insulating barrier is comprised of a plurality of layers of a continuous dielectric material.

7. The circuit interrupter according to claim 6 wherein said insulating barrier is comprised of a single sheet of dielectric material rolled into a tube which is inserted inside said outer housing and allowed to expand against said outer housing.

8. The circuit interrupter according to claim 1 wherein said means for blasting a flow of insulating gas comprises a stationary piston disposed within said tube, a puffer cylinder movable over said piston to compress the insulating gas therebetween, and an insulating nozzle directing the gas compressed between the piston and the puffer cylinder into the arc.

9. The circuit interrupter according to claim 1 including a control housing supporting said outer housing at an oblique angle.

* * * * *